US007856788B2

(12) United States Patent
Thompson

(10) Patent No.: US 7,856,788 B2
(45) Date of Patent: Dec. 28, 2010

(54) RECESSED WALL-WASH STAGGERED MOUNTING METHOD

(75) Inventor: Paul Thompson, Ecru, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 12/696,305

(22) Filed: Jan. 29, 2010

(65) Prior Publication Data

US 2010/0126109 A1 May 27, 2010

Related U.S. Application Data

(62) Division of application No. 11/463,768, filed on Aug. 10, 2006, now Pat. No. 7,673,430.

(51) Int. Cl.
*E04B 9/00* (2006.01)

(52) U.S. Cl. ..... 52/741.1; 52/506.06; 52/664; 52/28; 52/506.08; 248/317; 362/217.01; 362/217.13

(58) Field of Classification Search ..... 52/28, 52/506.06, 508, 664, 665, 669, 506.08; 248/317, 248/342, 316.7, 343, 228.7, 231.81; 362/217.06, 362/217.07, 217.12, 217.13, 364, 147, 148, 362/150, 404, 217.1, 288, 267, 365
See application file for complete search history.

(56) References Cited

U.S. PATENT DOCUMENTS

| | | | | |
|---|---|---|---|---|
| 1,704,990 | A | 3/1929 | Pierce | |
| 1,878,084 | A | 9/1932 | Winkler | |
| 2,219,383 | A | 10/1940 | Dillon | |
| 2,294,883 | A | 9/1942 | Anderson | |
| 2,317,428 | A * | 4/1943 | Anderson | 52/509 |
| 2,344,935 | A | 3/1944 | Whittaker | |
| 2,428,827 | A | 10/1947 | Beck | |
| 2,541,828 | A | 2/1951 | Peck | |
| 2,640,149 | A | 5/1953 | Arengerg | |
| 2,659,807 | A | 11/1953 | Wakefield | |
| 2,718,290 | A | 9/1955 | Segil | |
| 2,719,374 | A | 10/1955 | Paione | |
| 2,736,528 | A | 2/1956 | Le Brock | |
| 2,772,742 | A | 12/1956 | Sprankle | |
| 2,800,965 | A | 7/1957 | Church | |
| 2,817,752 | A | 12/1957 | Florence | |
| 2,831,962 | A | 10/1958 | Winkler | |
| 2,973,177 | A | 2/1961 | Stubbs | |
| 2,982,850 | A | 5/1961 | Lister | |
| 2,990,470 | A | 6/1961 | Bodian | |
| 3,003,735 | A | 10/1961 | Havener | |
| 3,011,047 | A | 11/1961 | Spaulding | |
| 3,018,083 | A | 1/1962 | Bobrick | |
| 3,019,332 | A | 1/1962 | Schiffer | |
| 3,061,258 | A | 10/1962 | Grenier | |
| 3,066,903 | A | 12/1962 | Tinnerman | |
| 3,066,904 | A | 12/1962 | Cook | |

(Continued)

*Primary Examiner*—Robert J Canfield
*Assistant Examiner*—Matthew J Gitlin

(57) ABSTRACT

The invention comprises a completely recessed wall-wash lighting fixture capable of being installed within a ceiling. The lighting fixture comprises a housing, which contains a lamp. The invention may comprise a lighting fixture further comprises a reflector disposed within the housing and adjacent to the first end of the housing. The invention may also comprise a flared lamp shield attached to the housing, which is capable of protecting the lighting fixture from damage. The lamp shield extends below the ceiling when the lighting fixture is installed.

7 Claims, 5 Drawing Sheets

U.S. PATENT DOCUMENTS 3,070,689 A 12/1962 McIntosh
3,118,621 A 1/1964 Bailey
3,155,324 A 11/1964 Chen
3,222,839 A 12/1965 Philpot
3,246,137 A 4/1966 Zagel
3,308,288 A * 3/1967 Ades ..... 362/150
3,319,059 A 5/1967 Ogden
3,349,237 A 10/1967 Jackson
3,374,979 A 3/1968 Coldren
3,383,811 A 5/1968 Ades
3,545,145 A 12/1970 Yousefpor
3,589,660 A 6/1971 Dunckel
3,599,921 A 8/1971 Cumber
3,601,862 A 8/1971 Hargadon
3,612,461 A 10/1971 Brown
3,626,176 A 12/1971 Tsugami
3,628,601 A 12/1971 Snaper
3,633,600 A 1/1972 Sadamori
3,652,780 A 3/1972 Wilson
3,668,998 A 6/1972 Johnson
3,687,055 A 8/1972 Dean, Jr.
3,701,895 A 10/1972 Sweetser
3,720,432 A 3/1973 Chudler
3,743,228 A 7/1973 Drab
3,750,136 A 7/1973 Roess
3,780,973 A 12/1973 Dalton
3,816,880 A 6/1974 Jacobs
3,843,086 A 10/1974 Ptak
3,883,732 A 5/1975 Peterson
4,048,493 A 9/1977 Lee
4,080,978 A 3/1978 McCabe
4,086,480 A 4/1978 Lahm
4,101,103 A 7/1978 Mooney
4,135,692 A 1/1979 Ferguson
4,149,226 A 4/1979 Dalton
4,158,221 A 6/1979 Agabekov
4,175,281 A 11/1979 Lonseth
RE30,204 E 2/1980 Root
4,191,352 A 3/1980 Schuplin
4,222,641 A 9/1980 Stolov
4,230,297 A 10/1980 Comer
4,240,133 A 12/1980 Haina
4,263,930 A 4/1981 McCabe
4,315,186 A 2/1982 Hirano
4,338,653 A 7/1982 Marrero
4,356,537 A * 10/1982 Stahlhut et al. ..... 362/148
4,388,642 A 6/1983 Reno, Jr.
4,389,096 A 6/1983 Hori
4,396,288 A 8/1983 Helphrey
4,407,011 A 9/1983 Lahm
4,408,262 A * 10/1983 Kusmer ..... 362/147
4,419,717 A * 12/1983 Price et al. ..... 362/148
4,424,554 A 1/1984 Woloski
4,435,047 A 3/1984 Fergason
4,449,589 A 5/1984 McCoy
4,463,896 A 8/1984 Schaus
4,494,175 A 1/1985 Gawad
4,494,450 A 1/1985 Avril
4,495,549 A 1/1985 Carlson
4,497,014 A * 1/1985 Woloski et al. ..... 362/150
4,522,541 A 6/1985 Bidwell
4,602,321 A 7/1986 Bornhorst
4,613,207 A 9/1986 Fergason
4,627,498 A 12/1986 Aalto
4,646,212 A 2/1987 Florence
4,705,255 A 11/1987 Reed
4,716,504 A 12/1987 Pahl
4,717,993 A 1/1988 Bernhart
4,726,781 A 2/1988 Bernhart
4,803,603 A 2/1989 Carson
4,860,180 A 8/1989 Degelmann
4,866,583 A 9/1989 Targetti
4,932,170 A * 6/1990 Spear ..... 52/28
4,933,820 A 6/1990 Engel
4,958,687 A 9/1990 Nakagawa
4,958,792 A 9/1990 Rinderer
4,980,808 A 12/1990 Lilos
5,050,047 A 9/1991 Viner
5,055,985 A 10/1991 Fabbri
5,072,344 A * 12/1991 Fabbri ..... 362/150
5,171,184 A 12/1992 Saucier
5,221,138 A 6/1993 Bostjancic
5,425,673 A 6/1995 Mahlanen
5,479,327 A 12/1995 Chen
5,533,696 A 7/1996 Laughlin
5,658,066 A 8/1997 Hirsch
5,667,181 A 9/1997 Van Leeuwen
5,755,507 A 5/1998 Hucks
5,777,857 A 7/1998 Degelmann
6,007,217 A 12/1999 Ferrier
6,047,517 A * 4/2000 Vrame ..... 52/506.06
6,155,921 A 12/2000 Evans
6,178,712 B1 * 1/2001 Sauer ..... 52/506.07
6,179,451 B1 * 1/2001 Bodine et al. ..... 362/404
6,203,421 B1 3/2001 Black
6,260,810 B1 7/2001 Choi
6,345,800 B1 * 2/2002 Herst et al. ..... 248/342
6,490,838 B2 * 12/2002 Summerford ..... 52/650.3
6,568,830 B2 5/2003 Yaphe
6,634,772 B2 10/2003 Yaphe
6,637,710 B2 10/2003 Yaphe
6,690,113 B1 2/2004 Ng
6,746,325 B2 6/2004 Crane
6,752,513 B2 6/2004 Plunk
6,769,784 B2 8/2004 Yaphe
6,776,509 B1 8/2004 Warner
6,854,860 B2 2/2005 Plunk
7,080,923 B2 7/2006 Plunk
7,195,372 B2 3/2007 Plunk
7,322,157 B2 * 1/2008 Hang ..... 52/506.08
7,377,084 B2 * 5/2008 Swiszcz et al. ..... 52/793.11
7,390,111 B2 * 6/2008 Lippis ..... 362/396
7,398,624 B2 * 7/2008 Swiszcz et al. ..... 52/506.08
7,413,323 B2 * 8/2008 Lippis et al. ..... 362/147
7,438,433 B1 * 10/2008 Steadman et al. ..... 362/147
7,478,931 B2 * 1/2009 Miletich et al. ..... 362/364
7,673,430 B1 * 3/2010 Thompson ..... 52/506.08
2004/0055239 A1 * 3/2004 Hang ..... 52/506.06
2005/0063190 A1 * 3/2005 Kosters et al. ..... 362/364

* cited by examiner

RECESSED WALL-WASH STAGGERED MOUNTING METHOD

CROSS-REFERENCE TO RELATED APPLICATIONS

This divisional application, under 35 USC §120, claims priority to, and benefit from, U.S. application Ser. No. 11/463,768, filed on Aug. 10, 2006, entitled "Recessed Wall Wash Staggered Mounting System," now U.S. Pat. No. 7,673,430, naming the above-listed individual as the sole inventor.

STATEMENT REGARDING FEDERALLY SPONSORED RESEARCH OR DEVELOPMENT

Not applicable.

BACKGROUND OF THE INVENTION

1. Field of the Invention

The present invention relates to recessed strip lighting fixtures. More particularly, the invention relates to an assembly and method for the more efficient placement of lighting fixtures in T-grids.

2. Background of the Invention

Strip lighting fixtures are commonly used in continuous rows to provide economical uniform lighting of large indoor spaces. Recessing the fixtures above the plane of the ceiling provides for more visual comfort than strip fixtures that are openly viewable. A popular form of conventional ceiling structure includes a grid work defined by individual frame sections of generally inverted T-shaped cross-section. The frame sections are formed into a series of rectangles, and the resulting formation is called a "T-grid." In standard T-grids, wall wash light fixtures are most usually installed in every other grid in the suspended ceiling. The mounting of the recessed wall wash fixture in the t-grid system is due to the requirement that the fixture mount on the cross bar or support bar of the T-grid. Thus, in T-grids, if light fixtures were directly adjacent to each other, each of the fixtures would mount in the same spot on the crossbar of the T-grid. Recessed lighting fixtures are typically installed in ceiling T-grids in rows and aligned so that no two fixtures are adjacent.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE DRAWINGS

While this invention is capable of embodiments in many different forms, multiple embodiments are shown in the figures and will be herein described in detail. The present disclosure is to be considered an exemplification of the principles of the invention and is not intended to limit the broad aspects of the invention to the embodiments illustrated.

Figure 1:
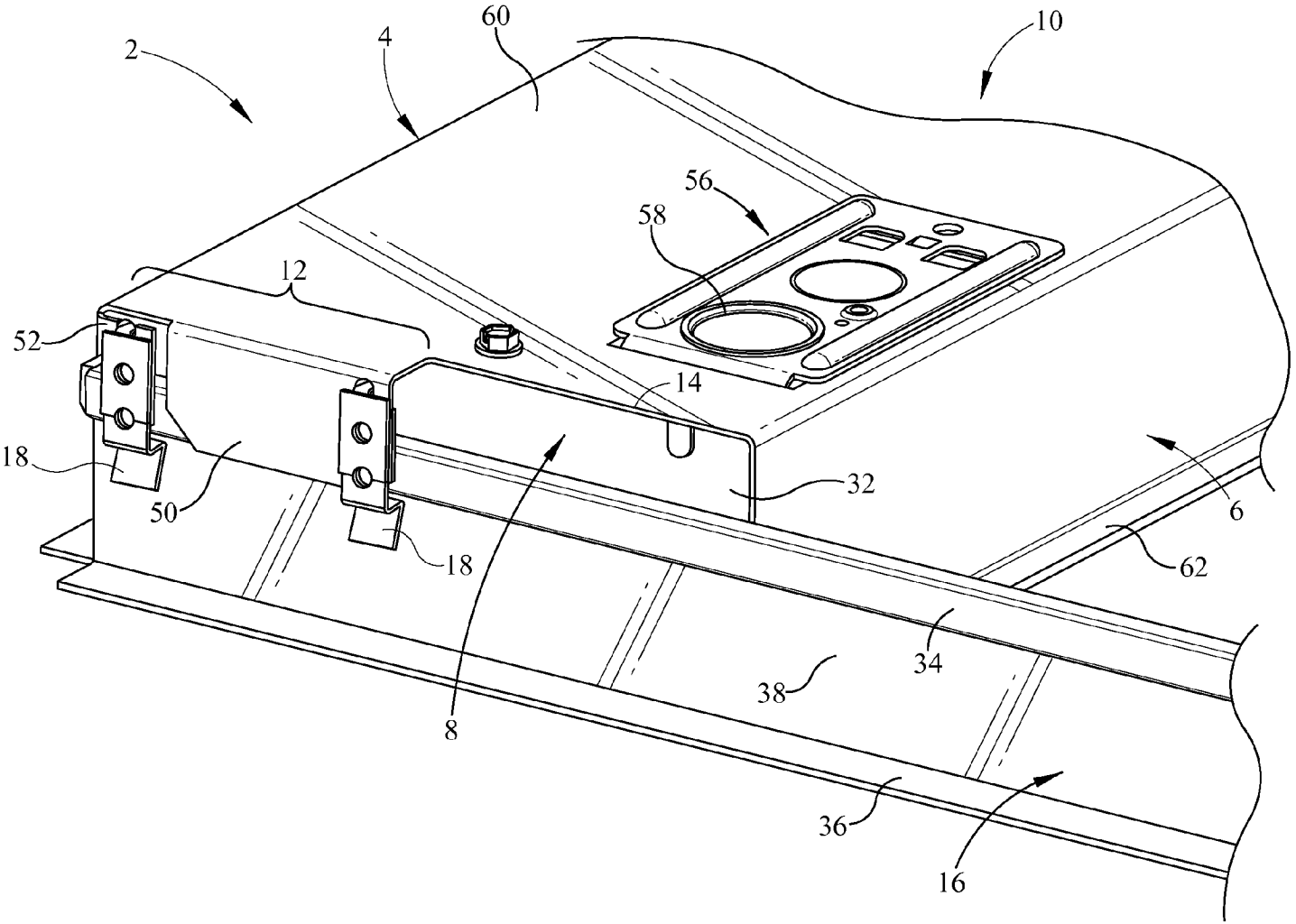
FIG. 1 is a front perspective view of a housing of the invention.
Figure 2:
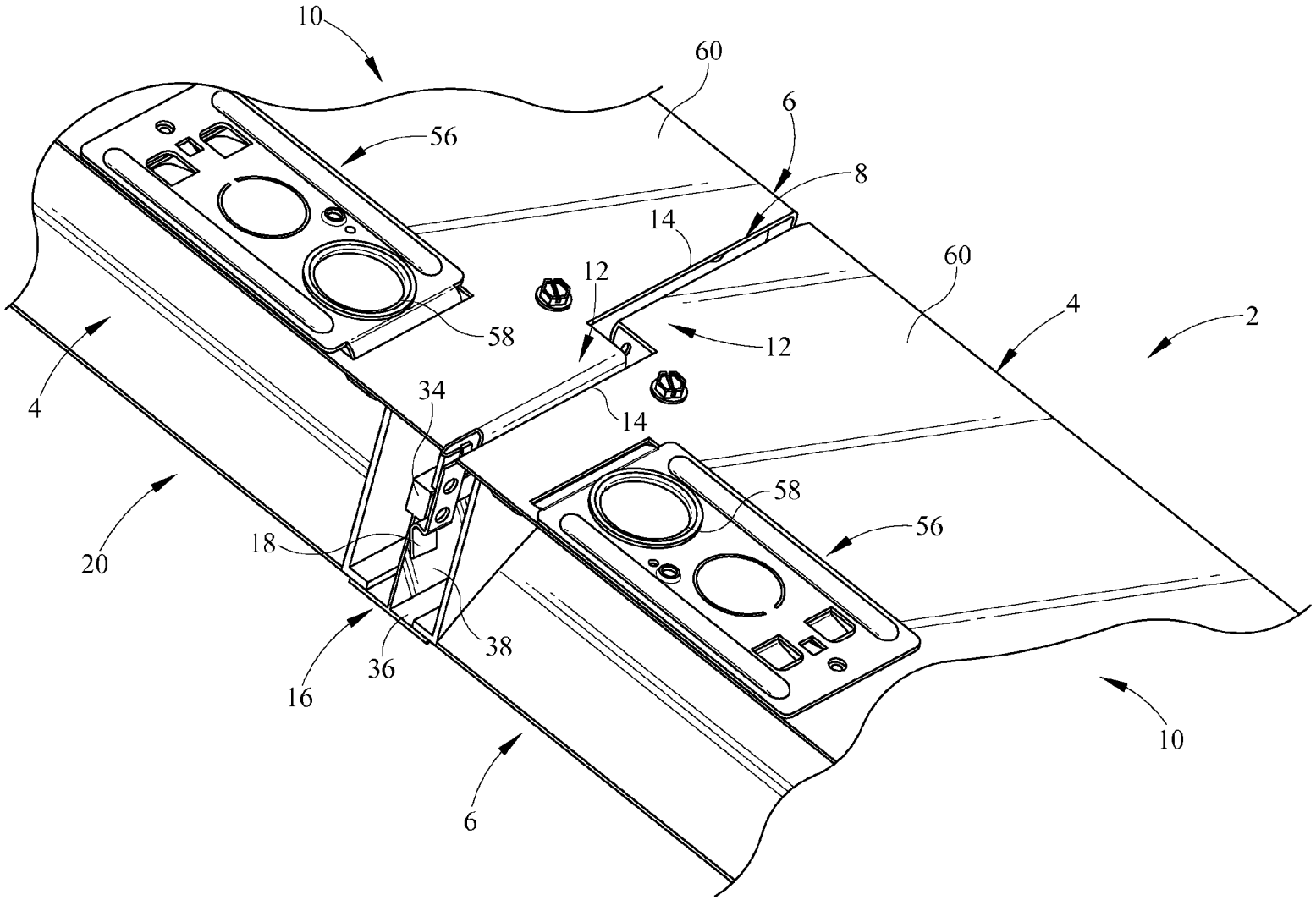
FIG. 2 is a top view of the housing of the invention.

Referring now to the drawings and specifically to FIG. 1, the invention comprises a staggered mounting system for a wall wash recessed lighting fixture in which housing can be laid adjacent to each other with, at most, a very small gap in between. FIG. 1 shows a first housing 2 of the invention that can be placed adjacent to a second housing 20, as shown in FIG. 2. In the embodiment shown in FIG. 1, the first housing 2 has a first side 8, a second side 10, a third side 4, and a fourth side 6.

The third side 4 and the fourth side 6 of the housing 2 are opposite each other, and the first side 8 and second side 10 are opposite each other. The first side 8 and the second side 10 each have a mounting extension 12 and a recessed indentation 14 that are positioned so that the mounting extension 12 of a first side 8 of a first housing 2 is capable of fitting into a recessed indentation 14 of a second side 10 of a second housing 20, as shown in FIG. 2. In a preferred embodiment, the mounting extension 12 of first side 8 is opposite the recessed indentation 14 of the second side 10.

Other possible embodiments of the housing 2 include those in which the mounting extensions 12 of the first side 8 and second side 10 are directly opposite each other, where they are offset, or where there are multiple mounting extensions 12 and recessed indentations 14.

As also shown in FIG. 1, the housing may have clips 18 that can be used to fasten the housing to the t-grid 16. The t-grid 16 is generally made of steel, sheet metal, or some other very durable, strong material that can support the weight of the housing 2 and any adjacent housings. First side 8 has a first flange 50 and a second flange 52 to which clips 18 attach. It is possible to have only a single flange, but having two flanges 50, 52 is desirable because each flange 50, 52 moves independently. If one flange is bent, the other one is not generally affected, which is desirable. Clips 18 extend down past the flanges 50, 52 and then extend back toward the housing 2 and then down and at an angle in somewhat of a checkmark fashion. The clips 18 are riveted on first flange 50 and second flange 52 of mounting extension 12 of the first side 8 of the housing 2. Flanges 50, 52 extend downward to about the middle of first side 8. When the housing 2 is mounted on the t-grid 16, the clips 18 extend past the top of the block-shaped top 34 of the t-grid 16 when the housing is in place on the t-grid 16. The clips 18 are biased outward and extend downward along flange 50 so that they are able to secure the housing 2 to the t-grid 16.

When the housing 2 is put into place on the t-grid 16, the clips 18 move outward away from the housing 2 until the clips 18 pass the block-shaped top 34 of the t-grid 16, at which time the clips 18 snap into place underneath the top 34 of the t-grid 16. The clips 18 prevent the housing 2 from coming off of the t-grid 16 and provide seismic restraint in case of an earthquake or other disturbance affecting the stability of the t-grid 16. Although the clips 18 prevent the housing 2 from coming off the t-grid 16 and coming out of the ceiling, they do not prevent the housing 2 from moving side to side along the base portion 36 of the t-grid 16. In fact, the housing 2 slides along the t-grid 16 until it is secured by placement of a ceiling tile against the housing 2. Other fastening mechanisms are possible, but the clips 18 allow the housing 2 to snap easily on the t-grid 16 and remain in place.

Figure 3:
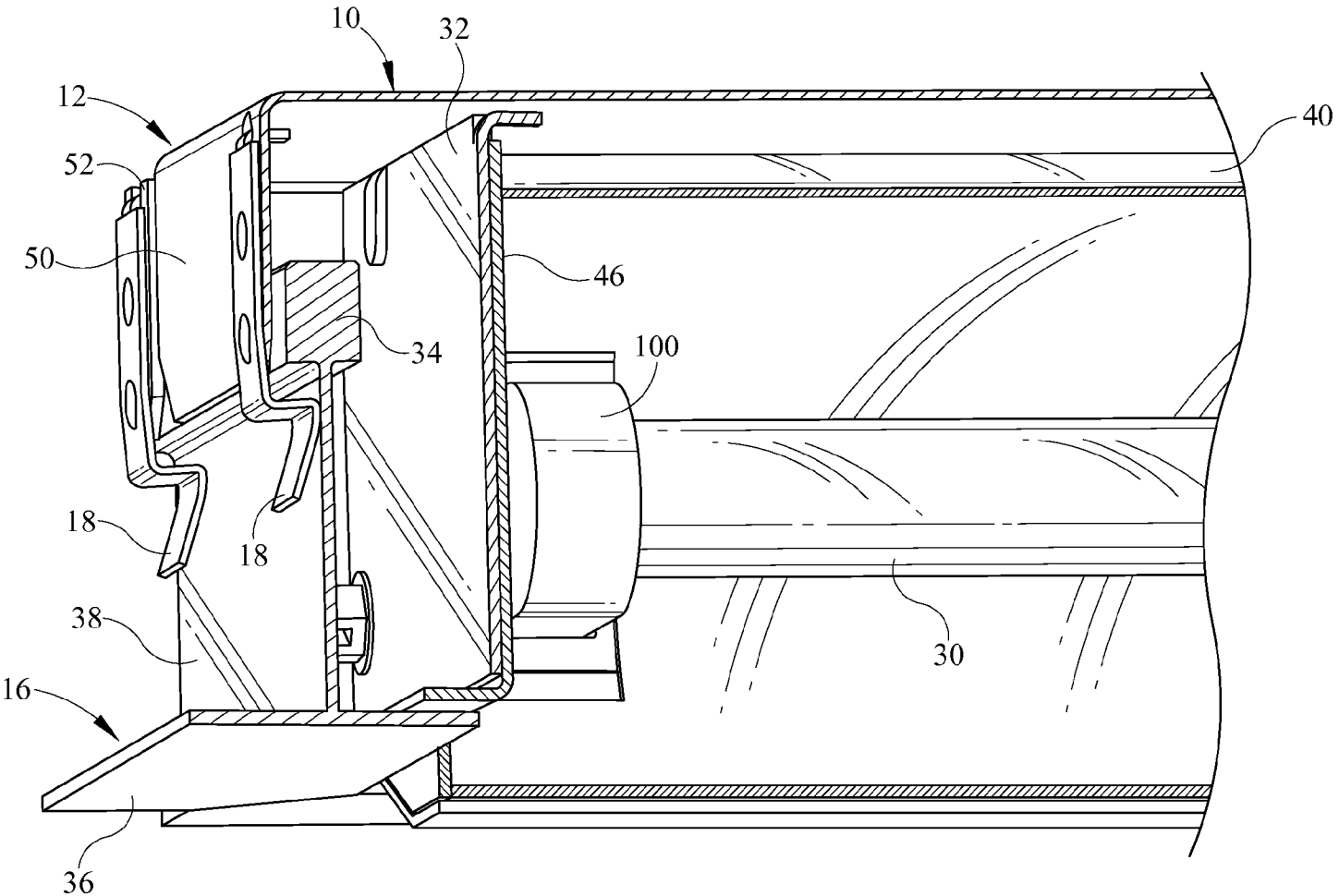
FIG. 3 is a side view of the housing of the invention.
Figure 5:
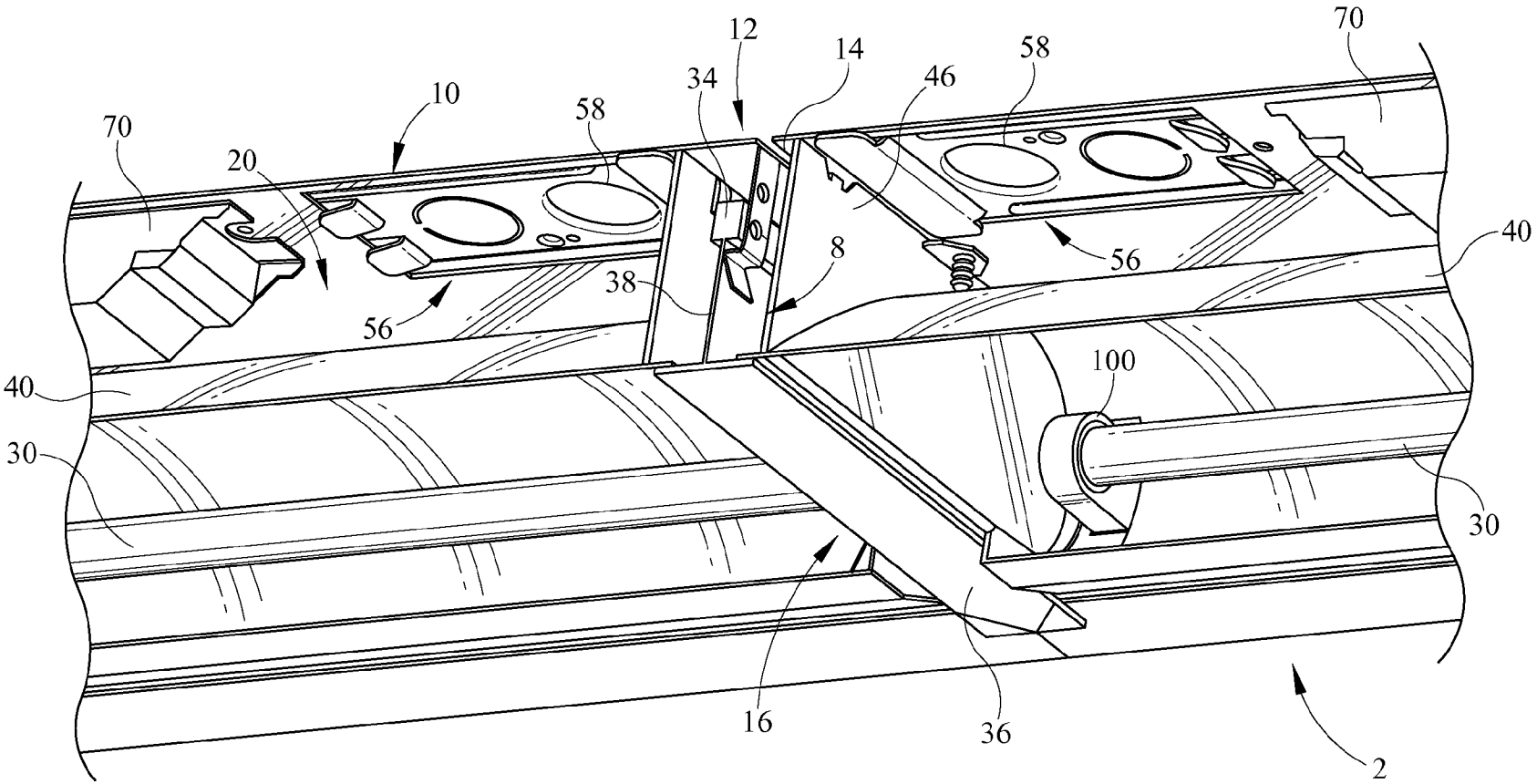
FIG. 5 is a bottom view of the housing of the invention.

In FIG. 1, while the mounting extension 12 is adjacent to the t-grid 16, recessed indentation 14 is spaced back from the t-grid 16 and is approximately half the length of the first side 8 of the housing. Mounting extension 12 takes up the other half of the length of first side 8. Wall 32 is positioned behind mounting extension 1. The recessed indentation 14 extends downward into wall 32, which rests on the base oft-grid 16, as seen in FIGS. 2, 3, and 5. Wall 32 extends behind mounting extension 12 and serves as the wall of the housing 2 for lamp 30, as seen in FIG. 3.

In one embodiment, housing 2 has a top side 60 that has a circular opening 58 in access cover 56 through which electrical wiring can be routed to a ballast 70. Incoming electrical wires go from an external electrical junction box, usually located in the ceiling, through opening 58 and into the housing 2. The wires are usually covered in conduit in order to protect them from being severed. After entering the housing 2, the wiring enters a transition box in order to switch from being covered with conduit to being uncovered before connecting to the ballast 70. The electrical wires enter ballast 70, and outgoing wires exit the ballast 70 and connect to lamp holder 100 holding lamp 30 to provide the lamp with electricity.

In the embodiment shown in FIG. 1, housing 2 also has a lip 62 along fourth side 6 upon which a ceiling tile can be placed when the housing 2 is positioned within the ceiling. In this embodiment, the ceiling tile is placed on top of the lip 62 and can be used to maneuver third side 4 of the housing 2 into place up against a wall so that the lamp 30 of the reflector 40 within the housing can light the wall. Housing 2 may also have a lip on third side 4 to facilitate placement of the housing 2 in the ceiling. In addition, the ceiling tile rests on t-grid 16, which has a base portion 36, a thin middle portion 38, and a block-shaped top 34. While the mounting extension 12 sits on the block-shaped top 34 of the t-grid 16, lip 62 rests on base portion 36, as does a ceiling tile that can be positioned adjacent to the housing 2.

In FIG. 2, a first housing 2 and an adjacent second housing 20 are shown. The first housing 2 and the second housing 20 both rest on the t-grid 16 in the middle of FIG. 2. The mounting extension 12 of the first housing 2 extends over the top of the t-grid 16, and clips 18 fasten the first housing 2 into place. The recessed indentation 14 of first housing 2 is set back from mounting extension 12 of the first housing 2. Mounting extension 12 of second housing 20 extends over the top of the opposite side oft-grid 16. In the embodiment shown in FIG. 2, light comes out of the second side 6 of second housing 20 and the third side 4 of first housing 2 so that the entire wall can be evenly covered by light from the wall-wash reflectors 40 within the housings 2, 20.

FIG. 3 shows the position of a lamp 30 in the first housing 2. The mounting extension 12 of first housing 2 is also shown more clearly. Clips 18 are riveted onto the first flange 50 and second flange 52, which extend downward from mounting extension 12. As also shown in FIG. 3, wall 32 extends behind mounting extension 12 and also forms the terminus of housing 2, which houses lamp 30. Clips 18 extend downward, and their checkmark type shape is clearly visible in FIG. 3. The clips 18 extend back toward the wall 32 and latch on to the block-shaped top 34 of the t-grid 16. The clips 18 join tightly to t-grid 16 so that the housing 2 remains firmly adjacent to the t-grid 16.

T-grid 16 further comprises a horizontal base portion 36 and a thin middle portion 38. Wall 32 of the housing 2 sits behind mounting extension 12 and rests on the base portion 36 oft-grid 16 when housing 2 is snapped into place. Thus, t-grid 16 supports housing 2 in two different places so that it maintains a firm position within the ceiling.

The reflector 40 and the lamp 30 are both within wall 32. In the embodiment shown in FIG. 3, the reflector 40 is a wall wash reflector that directs light from lamp 30 out the fourth side 6 of the housing 2. In one embodiment, the lamp 30 is a T5 fluorescent lamp, but it may also be any other type of lamp that can fit within a recessed housing such as the housing 2. A reflector end 46 is adjacent to wall 32 on the inside of the housing 2. The reflector end 46 is made of shiny or reflective material, such as glass, and reflect light out the end of the housing 2. The reflector end 46 is also decorative and gives the reflector 40 a finished look.

Figure 4:
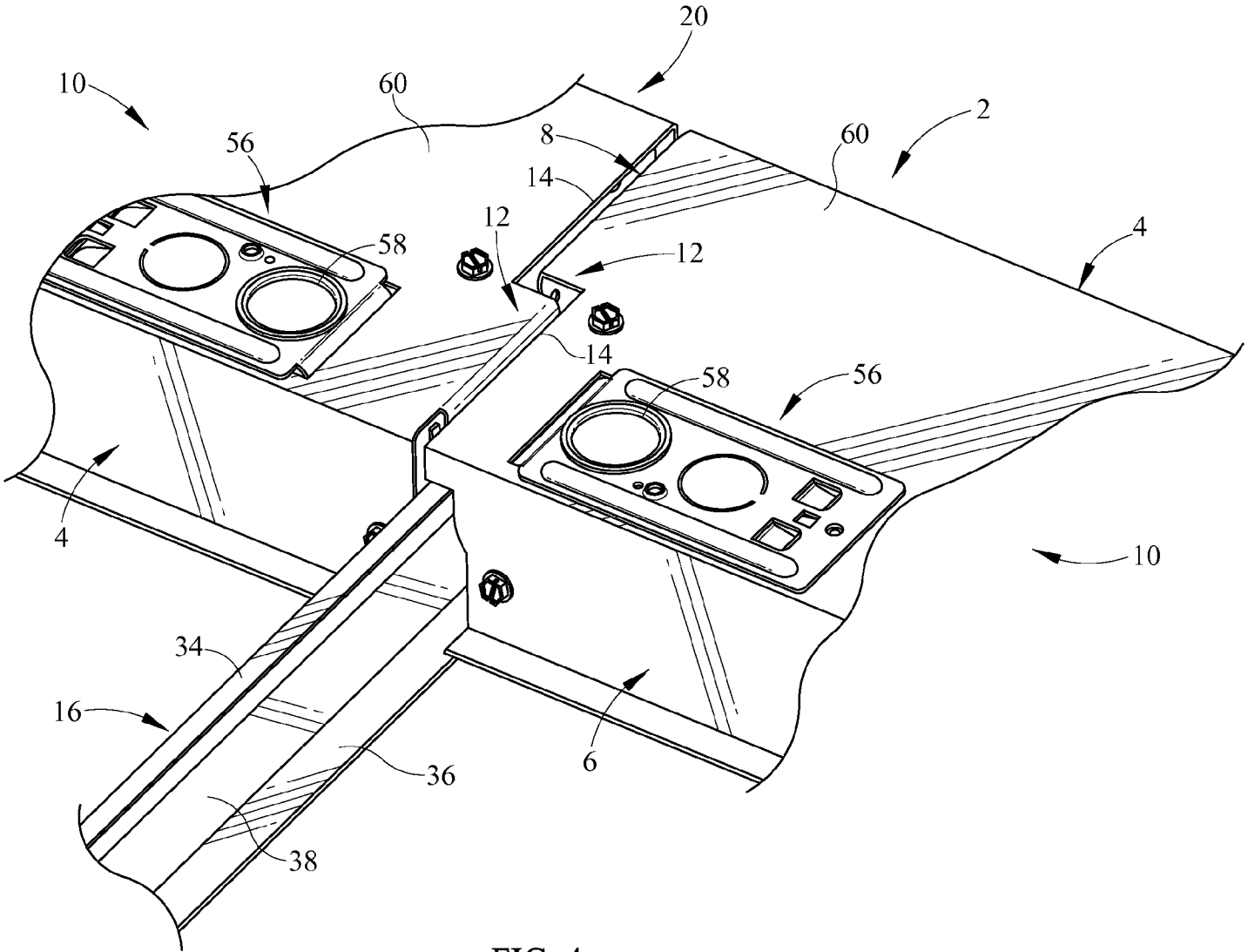
FIG. 4 is another top view of the housing of the invention.

FIG. 4 shows a perspective view of the top of the first and second housings 2, 20. As shown in this view the t-grid 16 extends back within the ceiling while the first and second housing 2, 20 face a wall that will be covered with light from lamps within the housings 2, 20. The clips 18 of the invention extend from mounting extensions 12, 12 of the first and second housings 2, 20 and clearly do not overlap each other, which allows first and second housings 2, 20 to be placed adjacent to each other. The adjacent placement leads to a much smoother and consistent "washing" effect of light on the wall. As shown in FIG. 4, the first and second housings 2, 20 are able to fit together very closely on a single t-grid 16.

The fourth side 6 of first housing 2 in FIG. 4 is closed so that no light escapes in that direction. Likewise, the third side 4 of second housing 20 is closed. The first side 8 of first housing 2 has a mounting extension 12 that is closes to the wall. The first side 8 of first housing 2 and second side 10 of second housing 20 are supported by t-grid 16, which leads back within the ceiling. Adjacent housings situated in the same positions as first and second housings 2, 20 are spaced throughout the ceiling.

Also shown in FIG. 4 are square slots on housings 2, 20 that are covered by access covers 56. Access covers 56 each have circular openings 58 through which wiring can be placed. Typically only one opening 58 will have wiring extend through it, but square slots are on the third 8 and second sides 10 of the housings so that the user has alternative methods of wiring the lamps 30 within the housings 2, 20.

FIG. 5 shows a view of the first and second housings 2, 20 from the side facing the wall. First side 8 of first housing 2 has reflector 40 situated inside of it. Lamp 30 is positioned within the reflector 40 so that light from the lamp 30 washes the wall adjacent to housing 2. T-grid 16 supports first housing 2 and second housing 20. Clip 12 fastens around block 34 oft-grid 16 and is adjacent to the thin middle 38 oft-grid 16. Like first housing 2, second housing 20 also has a reflector 40 and lamp 30. FIG. 5 also shows the access cover 56 having opening 58 through which wiring connects ballast 70 to an electrical source in the ceiling.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

What is claimed is:

1. A method of mounting a plurality of housings for a reflector in which a first housing can be placed adjacent to a second housing, comprising:

placing a first housing on a first t-grid and a second t-grid, wherein said first and second t-grids each have a block-shaped top, wherein said first housing has a first side having a mounting extension and a recessed indentation and a second side having a recessed indentation opposite the mounting extension of said first side and a mounting extension opposite said recessed indentation of said first side, wherein said mounting extension of said first side of said housing extends over said block-shaped top of said first t-grid, wherein said mounting extension of said second side extends over said block-shaped top of said second t-grid;

placing a second housing on a second t-grid and a third t-grid, wherein said second and third t-grids each have a block-shaped top, wherein said second housing has a first side having a mounting extension and a recessed indentation and a second side having a recessed indentation opposite the mounting extension of the first side and a mounting extension opposite said recessed indentation of said first side, wherein said mounting extension of said first side of said housing extends over said block-shaped top of said second t-grid, wherein said mounting extension of said second side extends over said block-shaped top of said third t-grid.

2. The method of claim 1, wherein said first and second housings have clips attached to said mounting extensions, wherein the method further comprises the step of attaching said clips to said block-shaped tops of said first and second housings.

3. The method of claim 2, wherein said first, second, and third t-grids each further comprise a thin middle portion and a base, wherein said method further comprises the step of placing a ceiling tile on said bases of said first and second t-grids adjacent to said first housing such that said ceiling tile is capable of keeping said first housing in place against a wall.

4. The method of claim 3 further comprising the step of placing a ceiling tile on said bases of said second and third t-grids adjacent to said second housing such that said ceiling tile is capable of keeping said second housing in place against a wall.

5. The method of claim 1, wherein said first housing has at least one opening on its top and contains a ballast, wherein electrical wiring connects from an outside electrical source to said ballast, wherein said ballast provides electricity for a lamp within said housing.

6. A method of mounting at least one housing a recessed troffer luminaire in a t-grid ceiling, comprising:

placing a first housing adjacent a first t-grid and a second t-grid, wherein said housing has a first side, a second side opposite said first side, a mounting extension and a recessed indentation on said first side and on said second side, wherein said second side has a recessed indentation opposite said mounting extension of said first side and a mounting extension opposite said recessed indentation of said first side;

positioning said mounting extension of said first side of said first housing over said first t-grid, wherein said mounting extension of said second side extends over said second t-grid.

7. The method of mounting a plurality of housings for a recessed troffer luminaire in a t-grid ceiling of claim 6 further comprising:

placing a second housing adjacent said second t-grid and a third t-grid, wherein said second housing has a first side having a mounting extension and a recessed indentation and a second side having a recessed indentation opposite the mounting extension of the first side and a mounting extension opposite said recessed indentation of said first side, wherein said mounting extension of said first side of said second housing extends over said second t-grid and wherein said mounting extension of said second side of said second housing extends over said third t-grid.

* * * * *